US005499091A

United States Patent [19]

Kasiwabara et al.

[11] Patent Number: 5,499,091

[45] Date of Patent: Mar. 12, 1996

[54] IMAGE FORMING APPARATUS HAVING A COUNTING DEVICE TO FACILITATE TWO-SIDED COPYING

[75] Inventors: Akihiro Kasiwabara, Tokyo; Mitsuhiro Mukasa, Kawasaki, both of Japan

[73] Assignee: Canon Kabushiki Kaisha, Tokyo, Japan

[21] Appl. No.: 228,399

[22] Filed: Apr. 15, 1994

[30] Foreign Application Priority Data

Apr. 19, 1993 [JP] Japan ..... 5-115391

[51] Int. Cl.[6] ..... G03G 21/00

[52] U.S. Cl. ..... 355/319; 355/308

[58] Field of Search ..... 355/204, 205, 355/206, 207, 208, 308, 309, 318, 319

[56] References Cited

U.S. PATENT DOCUMENTS 4,591,884 5/1986 Miyamoto et al. .

4,975,740 12/1990 Takemura et al. ..... 355/308 X 5,010,363 4/1991 Higashio et al. ..... 355/206

5,030,991 7/1991 Zaitsu et al. ..... 355/207

5,162,859 11/1992 Hirono et al. ..... 355/319 X 5,276,495 1/1994 Maruta et al. ..... 355/319 X 5,298,959 3/1994 Saito et al. .

5,315,360 5/1994 Yamauchi et al. ..... 355/319

FOREIGN PATENT DOCUMENTS 126726 12/1984 European Pat. Off. .

*Primary Examiner*—Sandra L. Brase

*Attorney, Agent, or Firm*—Fitzpatrick, Cella, Harper & Scinto

[57] ABSTRACT

An image forming apparatus, in which sheets on which image formation has been effected are once contained in an intermediate tray for second image formation and the sheets contained in the intermediate tray are re-fed to an image forming portion of the image forming apparatus to thereby effect plural times of image formation on a sheet, is characterized by a counting device for counting the sheets contained in the intermediate tray.

33 Claims, 8 Drawing Sheets

IMAGE FORMING APPARATUS HAVING A COUNTING DEVICE TO FACILITATE TWO-SIDED COPYING

BACKGROUND OF THE INVENTION

1. Field of the Invention

This invention relates to an image forming apparatus provided with an intermediate tray, such as a copying machine, a printer or a facsimile machine.

2. Description of the Related Art

Image forming apparatuses such as copying machines, printers and facsimile machines include apparatuses which can effect both-surface image formation, i.e., forming images on the front and back surfaces of a sheet material, and apparatuses of the multiplex type which effect image formation by superposing images on the front surface of a sheet material.

In an image forming apparatus shown in FIG. 3 of the accompanying drawings, originals (not shown) are successively set at a predetermined position on platen glass 3 by the use of an automatic original feeding device 2 provided on top of an image forming apparatus body 1. One of the originals set on the platen glass 3 is scanned by an optical system 4 and is exposed onto a photosensitive drum 5 rotating in a clockwise direction. An electrostatic latent image formed on the photosensitive drum 5 is developed into a toner image by toner supplied from a developing device 6.

Also, in this image forming apparatus, sheet materials S stacked on one of a plurality of sheet supply portions (a sheet supply cassette and a sheet supply deck) 7, 8, 9 are successively supplied to the photosensitive drum 5. The toner image on the photosensitive drum 5 is transferred onto the sheet materials S supplied to the photosensitive drum 5, by a transfer charger 10. The sheet materials S onto which the toner image has been transferred are sent to a fixating device 12 by a conveyor 11, and the fixation of the toner image is effected by the fixating device 12.

When the fixation of the toner image is terminated, the copying on one surface of the sheet materials S is terminated, but in the case of two-surface copying, copying on the other surfaces of the sheet materials S is effected subsequently and therefore, the sheet materials S are not discharged out of the apparatus, but are once stacked on an intermediate tray 13 in the image forming apparatus body 1. That is, in the case of two-surface copying, the sheet materials S on which the toner image has been fixated by the fixating device 12 are directed to a reversing path 15 by a reversing flapper 14 changed over to a position indicated by broken line, and are conveyed in the direction of arrow a, whereafter the sheets S are returned in the direction of arrow b and are directed to an intermediate tray discharge path 16, and are discharged onto the intermediate tray 13 by a pair of discharge rollers 17 or 18.

The sheet materials S onto the first surfaces of which the toner image has been transferred in this manner are successively stacked on the intermediate tray 13 with the first surfaces thereof facing upwardly.

When the copying onto the second surfaces is started, the sheet materials S stacked on the intermediate tray 13 are successively fed out from the lowermost one by a sheet feeding roller 19. As regards the sheet materials S thus fed out by the sheet feeding roller 19, the lowermost sheet is separated from the other sheet materials by a pair of separating rollers 20 and only the lowermost sheet is fed to the photosensitive drum 5. The toner image on the photosensitive drum 5 is transferred onto the second surface of the sheet material S fed to the photosensitive drum 5, by the transfer charger 10. The sheet material S onto the second surface of which the toner image has been transferred is sent to the fixating device 12 by the conveyor 11, and the toner image thereon is fixated by the fixating device 12.

When the fixation of this toner image is terminated, the copying on the both surfaces of the sheet material S is terminated, and the sheet materials S are successively discharged onto a sheet discharge tray 23 outside the apparatus by a pair of inner sheet discharge rollers 21 and a pair of outer sheet discharge rollers 22.

Reference is now made to FIGS. 4A to 4J of the accompanying drawings to describe the operation when a plurality of one-surface originals are to be copied on beth surfaces of a plurality of sheet materials S as a specific example of the two-surface copying operation in this image forming apparatus. Here, four one-surface originals are copied on both surfaces of each of two sheet materials S.

Four predetermined one-surface originals are first stacked and set on the original supporting table 2A of the automatic original feeding device 2 in the order of a first original P1, a second original P2, a third original P3 and a fourth original P4. In this state, a copying start key is depressed (FIG. 4A).

When a copying start signal is input, the automatic original feeding device 2 sets the lowermost fourth original P4 at a predetermined position on the platen glass 3. The optical system 4 scans this fourth original P4. On the other hand, a first sheet material S1 is supplied from one of the sheet supply portions 7, 8, 9 to the photosensitive drum 5, and the toner image on the photosensitive drum 5 (the image of the fourth original 4) is transferred onto a first surface of the first sheet material S1 (FIG. 4B).

Subsequently, the automatic original feeding device 2 skip-operates the third original P3 and makes it pass on the platen glass 3 (FIG. 4C). Subsequently, the automatic original feeding device 2 sets the second original P2 at a predetermined position on the platen glass 3, and the optical system 4 scans this second original P2. On the other hand, a second sheet material S2 is supplied to the photosensitive drum 5, and the toner image on the photosensitive drum 5 (the image of the second original P2) is transferred onto a first surface of the second sheet material S2 (FIG. 4D).

Subsequently, the automatic original feeding device 2 skip-operates the first original P1 and makes it pass on the platen glass 3. On the other hand, the first sheet material S1 and the second sheet material S2 onto the first surfaces of which the toner images have been transferred are successively stacked on the intermediate tray 13 (FIG. 4E). Subsequently, the automatic original feeding device 2 skip-operates the fourth original P4 and makes it pass on the platen glass 3 (FIG. 4F).

Subsequently, the automatic original feeding device 2 sets the third original P3 at a predetermined position on the platen glass 3, and the optical system 4 scans this third original P3. On the other hand, the first sheet material S1 is supplied from the intermediate tray 13 to the photosensitive drum 5, and the toner image on the photosensitive drum 5 (the image of the third original P3) is transferred onto a second surface of the first sheet material S1 (FIG. 4G). Subsequently, the automatic original feeding device 2 skip-operates the second original P2 and makes it pass on the platen glass 3 (FIG. 4H).

Subsequently, the automatic original feeding device 2 sets the first original P1 at a predetermined position on the platen glass 3. The optical system 4 scans this first original P1. On the other hand, the second sheet material S2 is supplied from the intermediate tray 13 onto the photosensitive drum 5, and the toner image on the photosensitive drum 5 (the image of the first original P1) is transferred onto a second surface of the second sheet material S2 (FIG. 4I). Subsequently, the first and second sheet materials S1 and S2 onto the second surfaces of which the toner images have been transferred are successively discharged onto the sheet discharge tray 23 outside the apparatus, and the predetermined two-surface copying operation is terminated (FIG. 4J ).

Now, when the above-described two-surface copying is effected, it is often the case that the sheet materials S1 and S2 temporarily stacked on the intermediate tray 13 are attracted to each other by electrostatic attraction caused by corona charge in the copying process onto the first surfaces thereof. Accordingly, when the sheet materials S1 and S2 in the intermediate tray 13 are re-fed, they are often fed in their mutually superposed relationship and are jammed. Or the sheet materials onto the first surfaces of which the toner images have been transferred are sometimes curled under the influence of the fixating process, whereby they are jammed.

In such cases, it is desirable that the sheet materials which have become unusable due to the jam be removed from the conveyance path and such that the remaining sheet materials be usable. However, the remaining sheet materials lack the pages before them and are therefore out of order in the correspondence of page order with the originals. There has heretofore been no image forming apparatus capable of handling this situation.

Accordingly, in the above-described image forming apparatus according to the prior art, if sheet materials re-fed from within the intermediate tray 13 are jammed when a plurality of one-surface originals are copied on both surfaces of a plurality of sheet materials, it has been impossible to set unjammed sheet materials in the intermediate tray 13 and use them, and such sheet materials could not be used.

SUMMARY OF THE INVENTION

The present invention has been made in view of the circumstances as noted above, and the object thereof is to provide an image forming apparatus designed such that when during the copying of a plurality of originals on both surfaces of a plurality of sheet materials or multiplex copying, the sheet materials re-fed from within an intermediate tray are fed in their mutually superposed relationship and are jammed, the unjammed sheet materials can be set in the intermediate tray for reuse.

The present invention relates to an image forming apparatus in which sheet materials on which the first image formation has been effected are once stacked and contained in an intermediate tray (55) in an image forming apparatus body (30) for the purpose of the second image formation and the sheet materials stacked and contained in said intermediate tray (55) are fed out one by one and re-fed to an image forming portion (34), whereby a second image formation is effected on a sheet material.

Such an apparatus is characterized by a circulation path (64) for returning the sheet materials fed out of said intermediate tray (55) to said intermediate tray (55) , and counting means (65) for counting the sheet materials passing through said circulation path (64).

According to the image forming apparatus of the present invention, when the sheet materials re-fed from the intermediate tray (55) are fed in their mutually superposed relationship and are jammed, the unjammed sheet materials are set in the intermediate tray, whereafter all the sheets in the intermediate tray are caused to make a round through the circulation path (64), whereupon the number of the sheet materials set in the intermediate tray is counted by the counting means (65). Accordingly, the control portion (70) of the image forming apparatus can judge the number of the jammed sheet materials from the count value counted by the counting means.

Thereby, image formation can be again effected on first surfaces of the jammed sheet materials and these sheet materials can be stacked and contained in the intermediate tray and therefore, the unjammed sheet materials can be set in the intermediate tray for reuse. Also, in the case of a system wherein the sheet materials in the intermediate tray are fed out in succession from the lowermost sheet material, the jammed sheet materials discharged onto the unjammed sheet materials can be changed in the order of stacking under the unjammed sheet materials by the unjammed sheet materials being again caused to make a round through the circulation path (64).

DETAILED DESCRIPTION OF THE PREFERRED EMBODIMENTS

Embodiments of the present invention will hereinafter be described with reference to the drawings.

Embodiment 1

Figure 1:
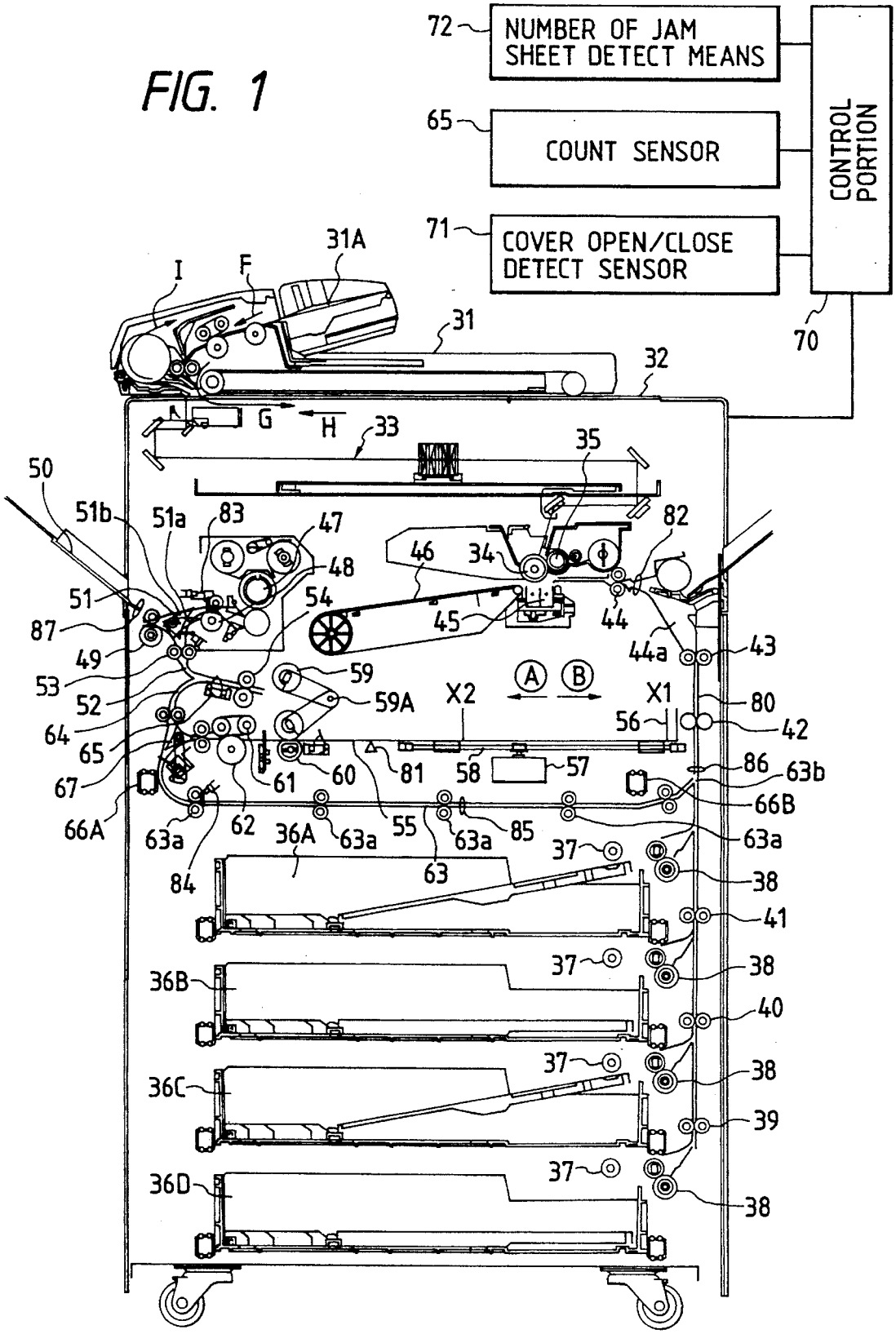
FIG. 1 is a vertical cross-sectional side view showing the general construction of an image forming apparatus (copying machine) according to Embodiment 1 of the present invention.

FIG. 1 shows the general construction of an image forming apparatus (copying machine) according to Embodiment 1 of the present invention.

In this image forming apparatus, originals (not shown) are successively set at a predetermined position on platen glass 32 by the use of an automatic original feeding device 31 provided on top of an image forming apparatus body 30. An optical system 33 scans the originals set on the platen glass 32 and exposes them onto a photosensitive drum 34 rotating in a clockwise direction. An electrostatic latent image formed on the photosensitive drum 34 is developed by a toner suppled from a developing device 35.

Also, a plurality of stages of sheet supply cassettes (front loading cassettes) 36A, 36B, 36C and 36D are provided in the lower portion of the image forming apparatus body 30 and one of sheet materials (not shown) stacked and contained in these sheet supply cassettes is selectively used. The sheet materials in the sheet supply cassettes 36A, 36B, 36C and 36D are fed out in succession from the uppermost sheet by a sheet feeding roller 37. As regards the sheet materials thus fed out by the sheet feeding roller 37, the uppermost sheet is separated from the other sheet material by a pair of separating rollers 38 and only the uppermost sheet is fed.

The sheet materials fed from the sheet supply cassettes 36A, 36B, 36C and 36D are conveyed to a pair of register rollers 44 stopped from rotating, by pairs of conveying rollers 39, 40, 41, 42 and 43, and their oblique movement is corrected by the pair of register rollers 44. The sheet materials having had their oblique movement corrected by the pair of register rollers 44 are fed to the transfer portion between the photosensitive drum 34 rotating in the clockwise direction and a transfer charger 45 by the pair of register rollers 44 starting to rotate in conjunction with the timing with the toner image on the photosensitive drum 34, and there the toner image on the photosensitive drum 34 is transferred to the sheet materials by the transfer charger 45.

The sheet materials to which the toner image has been transferred is sent to a fixating device 47 by a conveyor 46, and there the toner image transferred is fixated on the surface of each sheet material. The sheet materials on which the toner image has been fixated are discharged onto a sheet discharge tray 50 outside the apparatus by a pair of inner sheet discharge rollers 48 and a pair of outer sheet discharge rollers 49. At this time, a reversing flapper 51 installed between the pair of inner sheet discharge rollers 48 and the pair of outer sheet discharge rollers 49 is changed over to a position indicated by a solid line.

In the case of the beth-surface copy mode, the sheet materails on which the toner image has been fixated are directed to a reversing path 52 by the reversing flapper 51 changed over to a position 51*b*, and are discharged onto an intermediate tray 55 through the reversing path 52. In this case, the sheet materials directed to the reversing path 52 are conveyed by a pair of reversing rollers 53 and are discharged by a pair of discharge rollers 54.

Where the sheet materials discharged onto the intermediate tray 55 are of a small size such as size A4, a trailing end regulating plate 56 installed on the intermediate tray 55 for sliding in the directions of arrows A and B is moved from the X1 position to the X2 position after the discharge of a predetermined number of sheet materials and regulates the position of the trailing ends of the small-sized sheet materials. At this time, the leading ends of the small-size sheet materials are positioned downstream of a sheet feeding roller 60. Also, where the sheet materials discharged onto the intermediate tray 55 are of a large size such as size A3, the trailing end regulating plate 56 regulates the position of the trailing ends of the large-size sheet materials at the X1 position. At this time, the leading ends of the large-size sheet materals are positioned downstream of the sheet feeding roller 60.

The trailing end regulating plate 56 is secured to a timing belt 58 rotated by a motor 57, and is adapted to slide on the intermediate tray 55 in the directions of arrows A and B when the motor 57 is rotated in forward and reverse directions.

A sheet re-feeding state is brought about when a predetermined number of sheet materials on the first surfaces of which copying has been effected are stacked and contained in the intermediate tray 55. At this time, an auxiliary roller 59 rotated upwardly about a support shaft 59A and retracted is lowered to a predetermined position and urges the sheet materials on the intermediate tray 55 at a position corresponding to the sheet feeding roller 60. The sheet materials stacked and contained in the intermediate tray 55 are fed out in succession from the lowermost sheet by the sheet feeding roller 60. The sheet materials thus fed out by the sheet feeding roller 60 are sent to between a separating belt 61 and a feed roller 62 and there, the lowermost sheet is separated from the other sheet materials and only the lowermost sheet is fed downstream.

A re-feeding path 63 made to branch off by a flapper 67 provided downstream of the feed roller 62 is provided and the downstream end thereof joins a conveyance path 44*a* from the cassettes at a joining point 63*b*. The sheet materials being re-fed are conveyed by pairs of conveying rollers 63*a* provided in the re-feeding path 63.

The sheet materials fed from within the intermediate tray 55 pass through the re-feeding path 63 and are conveyed to the pair of register rollers 44 stopped from rotating, and their skew feed is corrected by the pair of register rollers 44. The sheet materials having had their skew feed corrected by the pair of register rollers 44 are thereafter subjected to the transfer of a toner image onto the second surfaces thereof and the fixation of the toner image is the same procedure as in the case of the above-described transfer of the toner image onto the first surface and thus, two-surface copying is completed, and the sheet materials are discharged onto the sheet discharge tray 50 by the pair of inner sheet discharge rollers 48 and the pair of outer sheet discharge rollers 49.

In the present image forming apparatus, the original feeding operation of the automatic original feeding device 31 and the flow of the sheet materials when a plurality of one-surface originals are copied on both surfaces of a plurality of sheet materials are effected in the same manner as in the case of the above-described image forming apparatus according to the prior art.

In the present image forming apparatus, a circulation path 64 for returning the sheet materials fed out of the intermediate tray 55 to the intermediate tray 55 and a count sensor (counting means) 65 for counting the sheet materials passing through the circulation path 64 are provided as a countermeasure for the jamming of the sheet materials re-fed from the intermediate tray 55 which may be caused when a plurality of one-surface originals are copied on both surfaces of a plurality of sheet materials. The circulation path 64 is made to branch off by the flapper 67 and joins the reversing path 52, and the range thereof is from the flapper 67 to the pair of discharge rollers 54.

When the sheet materials re-fed from the intermediate tray 55 are jammed, sheet materials onto which the transfer of the toner image from the photosensitive drum 34 has not yet been effected and which are stagnating in the conveyance path 44*a* or the re-feeding path 63 and are located upstream of the jammed sheet materials (e.g., if sheet materials are torn or broken when they are taken from the path, sheets which are located upstream of those sheet materials) are returned to the intermediate tray 55 so that the order thereof is not made erroneous. All the sheet materials in the intermediate tray 55 are fed out and are caused to make a round through the circulation path 64. In this case, the flapper 67 is changed over from its shown position. If this is done, the number of unjammed sheets set in the intermediate tray 55 will be counted by the count sensor 65.

The intermediate tray 55 is provided with a one-round sensor 81 for detecting that the sheet materials set in the intermediate tray 55 have all been once fed out and returned to the intermediate tray 55 through the circulation path 64. This is for preventing double counting. Accordingly, the control portion 70 of the image forming apparatus becomes capable of calculating how many sheet materials as counted from a low page number have been copied on their first surfaces, from the count value counted by the count sensor 65.

In the present image forming apparatus, the intermediate tray 55, the sheet feeding roller 60, the separating bolt 61, the feed roller 62, the re-feeding path 63 between rails 66A and 66B, the flapper 67 and the circulation path 64 between the discharge rollers 54 are made into a unit (an intermediate tray unit) so that they can be moved on the rails 66A and 66B and pulled out to the front side of the image forming apparatus body 30.

Accordingly, when the sheet materials re-fed from the intermediate tray 55 are jammed, the front side cover (not shown) of the image forming apparatus body 30 is opened and the jammed sheet materials are removed with the intermediate tray unit pulled out.

Description will now be made of the operation of the control portion 70 when the sheet materials re-fed from the intermediate tray 55 are jammed.

When a jam occurs, the jammed sheet materials are first removed and the sheet materials upstream thereof onto which the toner image has not yet been transferred are set in the intermediate tray 55. The intermediate tray unit is then set into a predetermined position in the image forming apparatus body 30, and the front side cover is closed.

When a detection signal from detecting means 71 for detecting that the front side cover has been closed is inputted to the control portion, the control portion causes the sheet materials in the intermediate tray 55 to be fed out and make a round through the circulation path 64, and counts the number of sheet materials to only the second surfaces of which the toner image can be transferred (the number of the sheet materials remaining in the intermediate tray). Thereby, the number of the removed sheet materials is calculated by jammed sheet number detecting means 72 from the count value counted by the count sensor 65. This can be expressed by an expression: (number of designated copies)−{(number of completed copies)+(number of sheet materials remaining in the intermediate tray)}= number of removed sheets.

The number of completed copies is the number of sheet materials on the first and second surfaces of which the images have been formed and fixated by the fixating device 47 and which have been discharged onto the sheet discharge tray 50 and have been detected by an outer sheet discharge sensor 87.

Also, sheet sensors 81, 82, 83, 84, 85 and 86 for detecting the presence of sheet materials are provided in the conveyance path 44*a* and re-feeding path 63 of the image forming apparatus according to the present embodiment, and on the basis of signals from these sheet sensors, the control portion judges whether the sheet materials have been jammed. That is, when a predetermined one of the sheet sensors does not detect any sheet material even when a predetermined time sufficient for a sheet material to arrive at said predetermined sheet sensor has elapsed after the start of sheet feeding or after a sheet material has passed the upstream sheet sensor, the control portion judges that a jam has occurred to the sheet materials. Also, when during the conveyance of the sheet materials, the predetermined sheet sensor detects sheet materials even if a time sufficient for a sheet material to pass has elapsed after the predetermined sheet sensor has detected a sheet material, the control portion judges that a jam has occurred.

Subsequently, the control portion causes sheet materials corresponding in number to the removed sheet materials to be fed from the cassettes, again effects copying (the same image as that on the jammed sheet materials) on the first surfaces of these sheet materials, and causes these sheet materials to be discharged into the intermediate tray 55 and stacked on the sheet materials remaining in the intermediate tray. At this time, the original feeding device 31 repeats skip and feeds an original having the same image as the image on the first surfaces of the jammed sheet materials to the platen glass 32. Subsequently, of the sheet materials set in the intermediate tray 55, sheet materials corresponding in number to the sheet materials having remained in the intermediate tray are again fed out and are caused to make a round through the circulation path 64, and are returned to the intermediate tray 55 and counted by the counting sensor 65.

By this operation, new sheet materials corresponding in number to the removed sheet materials and the sheet materials remaining in the intermediate tray are stacked in succession from the bottom and a jam-recovered state is brought about.

Subsequently, by the operation of a start button (not shown), the sheet materials in the intermediate tray 55 are successively re-fed and copying is effected on the second surfaces thereof.

Also, when the sheet materials have made a round through the circulation path 64, if the sheet materials are small-size sheet materials, the trailing end regulating plate 56 moves from the X1 position to the X2 position and regulates the trailing ends of the small-size sheet materials.

While in the above-described operation, the sequence has automatically progressed, design may be made such that the sequence progresses each time the operator depresses an operation button on the basis of a message such as "Please depress the button. The number of sheets is counted," "Please depress the button. Jammed sheets are replenished," or "Please depress the button. Jammed sheets are recovered."

Description will now be made of a case where ten two-surface copies are taken from twenty sheets of one-surface originals. Twenty sheets of originals put in order of pages are placed in the tray 31A of the automatic original feeding device 31 with their image bearing surfaces facing upward. When the mode of "one-surface original→two-surface copy" is set and the copy button is depressed, the automatic original feeding device 31 feeds out the lowermost twentieth original P20 in the direction of arrows F and G, and stops it at a predetermined position on the platen glass 32. The twentieth original P20 is then exposed by the optical system 33.

On the other hand, a sheet material S10 fed from one of the sheet supply cassettes 36A, 36B and 36C, for example, the cassette 36A, has its skew feed corrected by the pair of register rollers 44 and is fed in timed relationship with the toner image of the twentieth original P20 formed on the photosensitive drum 34. The sheet S10 to which the toner image has been transferred has the toner image thereon fixated by the fixating device 47, whereafter it is directed to the reversing path 52 by the reversing flapper 51 and is discharged onto the intermediate tray 55. The twentieth original P20 is fed in the direction of arrows H and I by the automatic original feeding device and is discharged onto originals stacked on the tray 31A. The next, i.e. , the nineteenth original P19 is likewise fed onto the platen glass 32, but is skipped and is discharged onto the tray 31A without being exposed. The eighteenth original P18 is exposed like the twentieth original P20, and the image thereof is copied on a sheet material S9, which is then discharged onto the intermediate tray 55.

Thereafter, odd-number originals from the seventeeth original P17 to the first original P1 are skipped and discharged onto the tray 31A, and even-number originals from the sixteenth original P16 to the second original P2 are exposed on the platen glass 32, and then are discharged onto the tray 31A. The images of these even-number originals are copied on sheet materials S8–S1, which are then discharged onto and stacked on the intermediate tray 55. Subsequently, the automatic original feeding device 31 causes the originals stacked on the tray 31A in the original order to be fed out to the platen glass 32 in succession from the lowermost twentieth original P20. The even-number originals are now skipped and discharged onto the tray 31A, and the odd-number originals are discharged onto the tray 31A after exposure.

The sheet materials stacked on the intermediate tray 55 are fed out in the order of S10, S9, . . . , S1 from under by the sheet feeding roller 60, pass through the re-feeding path 63 and the conveyance path 44*a*, are adjusted in timing and are fed to the transfer portion. The toner images of the odd-number originals P19, P17, P15, . . . , P1 are successively formed on the photosensitive drum 34, are fed to the transfer portion and are transferred to the sheet materials S10, S9, . . . , S1. In this manner, the images of the even-number originals P20, P18, P16, . . . , P2 are formed on one surface of the sheet materials S10–S1 and the images of the odd-number originals P19, P17, . . . , P1 are successively transferred to the other surfaces of the sheet materials S10–S1 re-fed from the intermediate tray 55, and are fixated by the fixating device 47. The flapper 51 is at a position 51*a* for directing the sheet materials from the inner discharge roller 48 to the outer discharge roller 49 and therefore, after fixation, the sheet materials are discharged onto the discharge tray 50 by the inner and outer discharge rollers 48 and 49. In this manner, copying on both surfaces is completed.

Description will now be made of a case where the sheet material 7S fed out of the intermediate tray 55 is not detected by the sensor 87 at predetermined timing and the control portion 70 judges that a jam has occurred.

When it is judged that a jam has occurred, the control portion immediately stops the copying process and the sheet conveyance, and causes the display portion to display the occurrence of a jam. The user opens the cover of the apparatus and removes the jammed sheet materials. In this case, the sheet materials 7 are jammed before and behind the pair of fixating rollers 47 and therefore, those sheet materials 7 are first removed. On the upstream side of the fixating rollers 47, a sheet material 6S is stopped on the conveyor 46, and on the upstream side of the pair of register rollers 44, a sheet material 5S is stopped, and sheet materials 4S and 3S are stopped in the re-feeding path 63.

The sheet material 7S which has caused the jam cannot be reused because a number of wrinkles or breakage is created therein. Also, an unfixated toner image is formed on the sheet material 6S on the conveyor 46 and this sheet material also cannot be used. Consequently, the sheet materials 7S and 6S are discarded. The remaining sheet materials 5S, 4S and 3S are returned to the intermediate tray 55 in such a manner that they are in the original order of 5S, 4S, 3S, . . . , 1S from the bottom. At this time, the sheet materials 5S, 4S and 3S are placed under the sheet materials left in the intermediate tray 55.

When the body cover is closed, the display that "Please depress the button. Recovery is done." is effected. When the user depresses the button, all the sheet materials in the intermediate tray 55 are successively fed out by the sheet feeding roller 60. The thus fed-out sheet materials are directed to the circulation path 64 by the moved flapper 67 and are again returned to the intermediate tray 55. At this time, the count sensor 65 produces signals by the sheet materials passing it, and by counting the signals, the control portion 70 counts the sheet materials in the intermediate tray 55. When all the sheet materials are once counted by the one-round sensor 81, the counting is terminated. In this case, five sheet materials 5S–1S are placed in the intermediate tray 55. Also, sheet materials 10S, 9S and 8S have the images of the originals 20P, 19P, 18P, 17P, 16P and 15P copied on the both surfaces thereof and are discharged onto the sheet discharge tray 50.

The discharge sensor 87 detects the discharged sheet materials, and the control portion 70 counts them and stores the count value thereof in a memory. The control portion 70 deduces the number of removed sheet materials from the number of discharged sheet materials (the number $n_1$ of completed copies) in the memory, the number of sheet materials in the intermediate tray 55 (the number $n_2$ of sheet materials remaining in the intermediate tray) and the number of sheet materials necessary for the completion of all copies calculated from the number of originals (the number N of copies). In the case of two-surface copy, N is ½ of the number of all pages of the originals. In this case, $$(\text{number } N \text{ of copies}) - (\text{number } n_1 \text{ of completed copies}) - (\text{number } n_2 \text{ of sheet materials remaining in intermediate tray}) = 10 - 3 - 5 = 2.$$

Moreover, the control portion 70 also recognizes that sheet materials 5S–1S remain in the intermediate tray and therefore, judges that sheet materials 6S and 7S have been removed.

Subsequently, in place of the removed sheet materials 6S and 7S, sheet materials 7S' and 6S' on the first surfaces of which the images of the originals 14P and 12P have been copied are supplied to the intermediate tray. The originals are successively skipped by the automatic original feeding device, and the fourteenth original 14P is stopped on the platen glass 32. The image of the fourteenth original 14P is then formed on the sheet material 7S' fed out of the cassette 36A by the sheet feeding roller 37, and the sheet material 7S' is discharged onto the intermediate tray 55. Likewise, the twelfth original 12P is stopped on the platen glass 32, and the image of the twelfth original 12P is formed on the sheet material 6S' fed out of the cassette 36A and the sheet material 6S' is discharged onto the intermediate tray 55. Subsequently, the order of stacking of the sheet materials in the intermediate tray 55 is restored to the original order. That is, sheet materials corresponding to the counted number (five) of the sheet materials remaining in the intermediate tray are fed out of the intermediate tray by the sheet feeding roller 60 so that the newly-supplied sheet materials 7S' and 6S' may become lowermost. The sheet materials thus fed out are directed to the circulation path 64 by the flapper 67 and are returned to the intermediate tray 55. Thus, the sheet materials have been stacked in the order of 7S', 6S', 5S, 4S, . . . , 1S from the bottom.

Subsequently, the sheet materials are fed out in succession from the bottom by the sheet feeding roller 60. The sheet materials thus fed out are directed to the re-feeding path 63 by the flapper 67 now moved to its original position and are conveyed to the transfer portion.

On the other hand, the automatic original feeding device 31 repeats skipping and feeds the thirteenth original 13P to be copied on the second surface of the sheet material 7S' to the platen glass 32 and stops the thirteenth original 13P thereon. The thirteenth original 13P is then exposed by the optical system 33 and is copied on the second surface of the sheet material 7S'.

Subsequently, the originals 11P, 9P, 7P, . . . , 1P are copied on the second surfaces of the sheet materials 6S', 5S, 4S, . . . , 1S and thus, the copying operation is completed.

Embodiment 2

Figure 2:
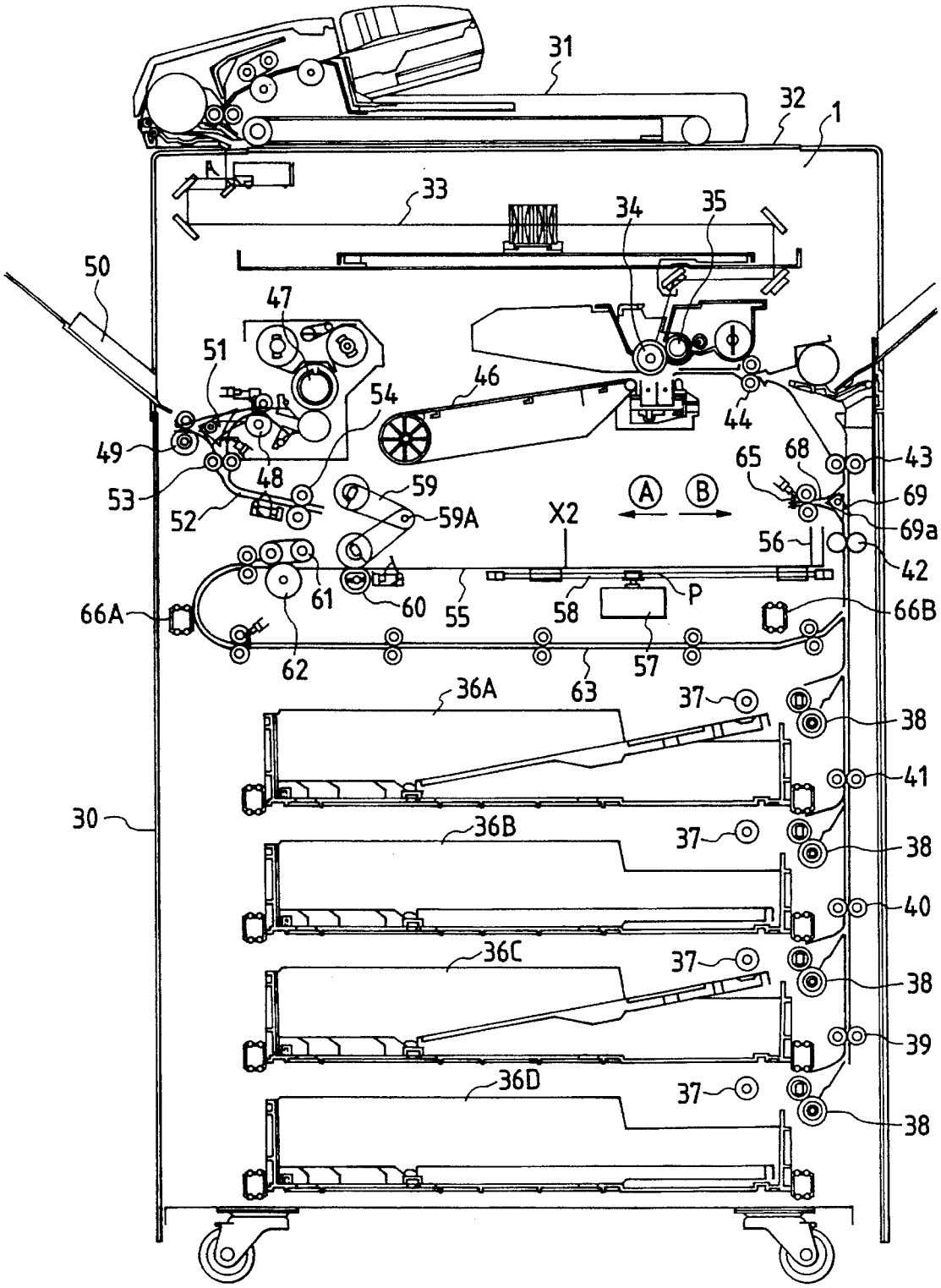
FIG. 2 is a vertical cross-sectional side view showing the general construction of an image forming apparatus (copying machine) according to Embodiment 2 of the present invention.
Figure 3:
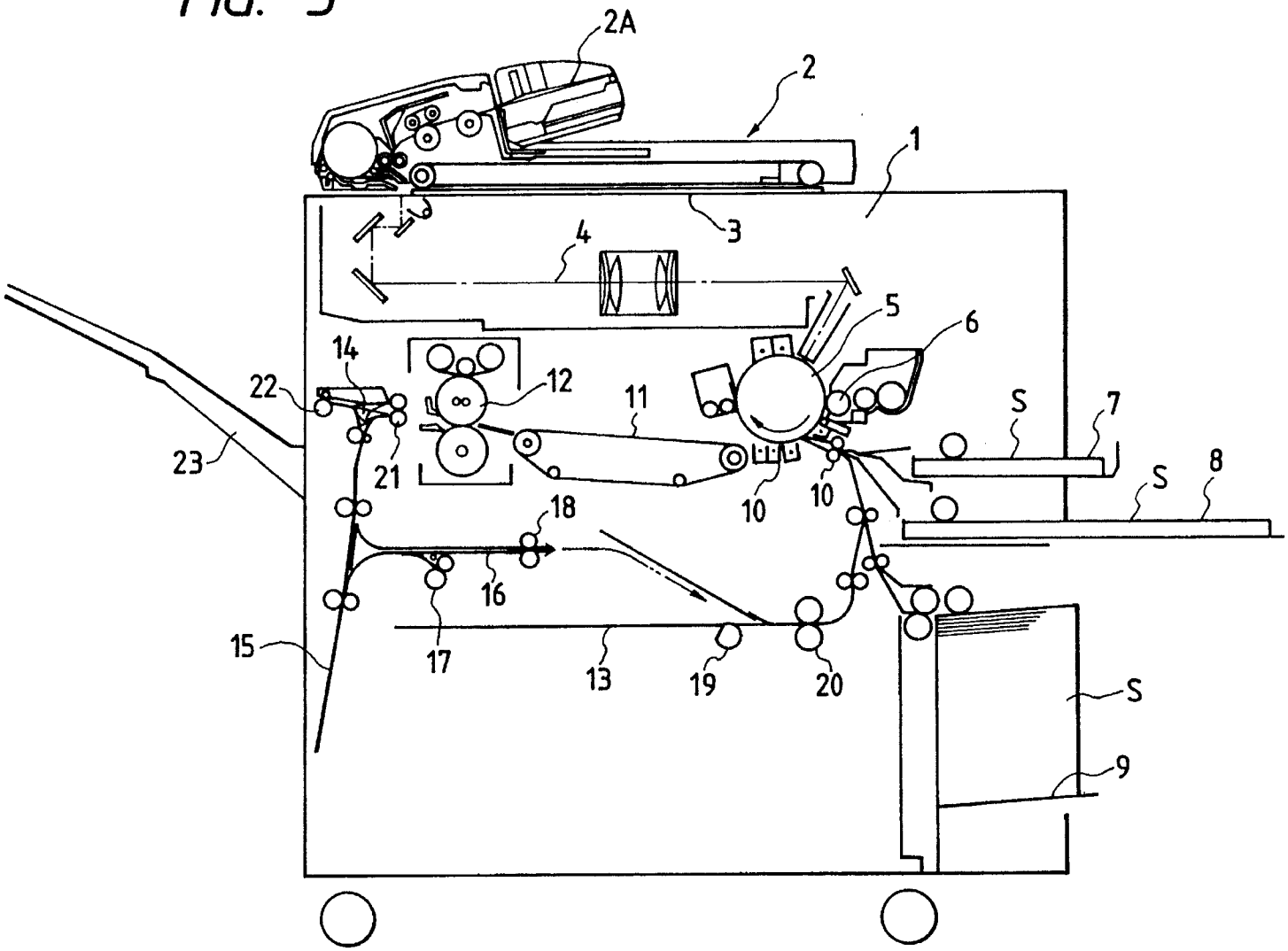
FIG. 3 is a vertical cross-sectional side view showing the general construction of an image forming apparatus (copying machine) according to the prior art.
Figure 4B:
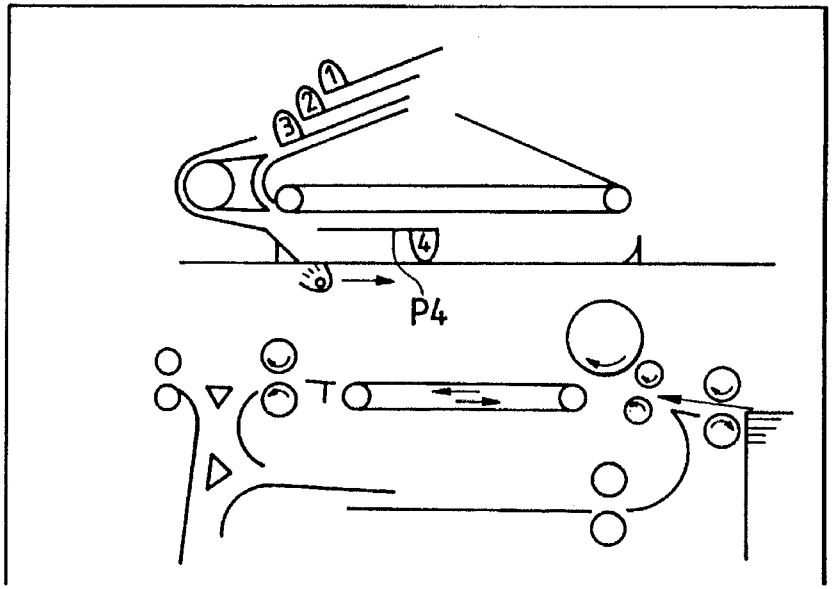
FIGS. 4A to 4J are conceptual views for illustrating the operation when in the image forming apparatus of FIG. 3, a plurality of one-surface originals are two-surface-copied on a plurality of sheet materials.
Figure 4A:
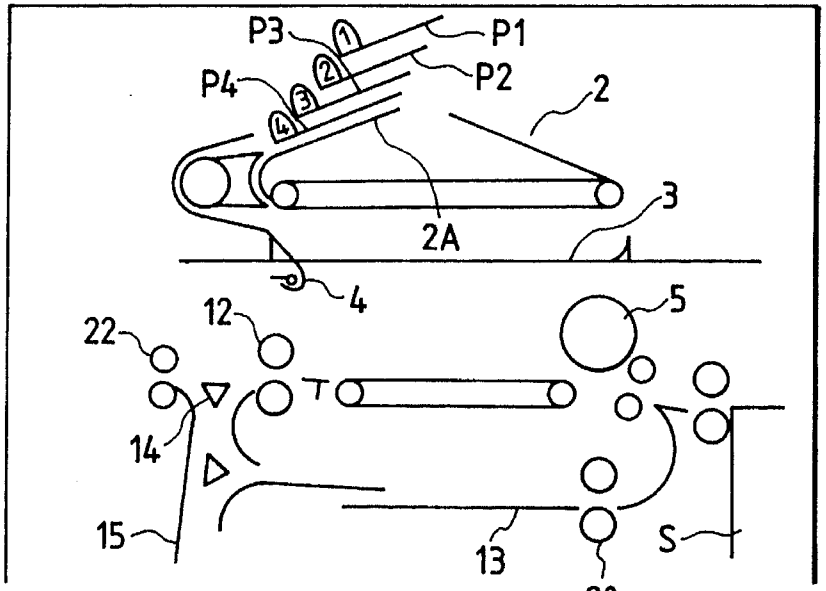
Figure 4D:
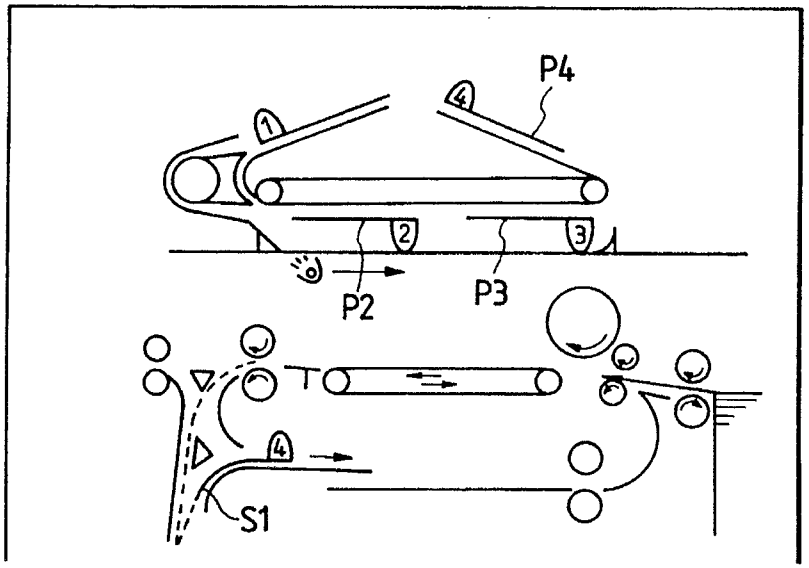
Figure 4C:
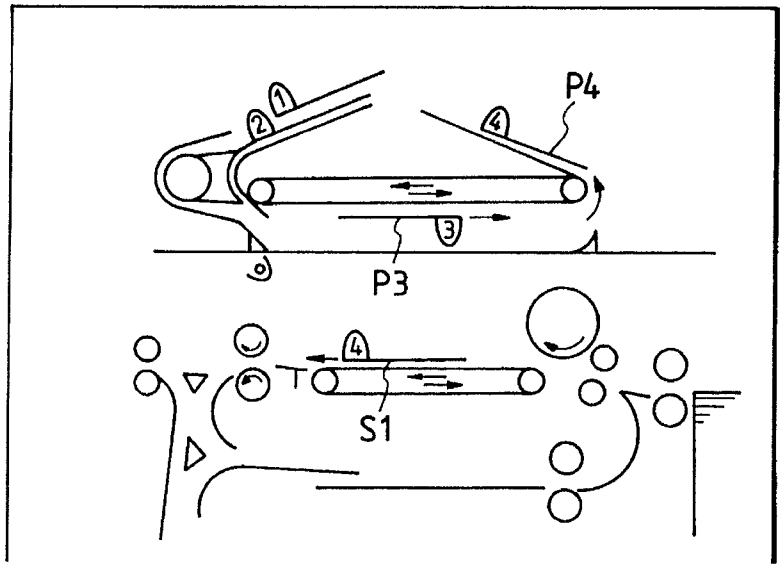
Figure 4F:
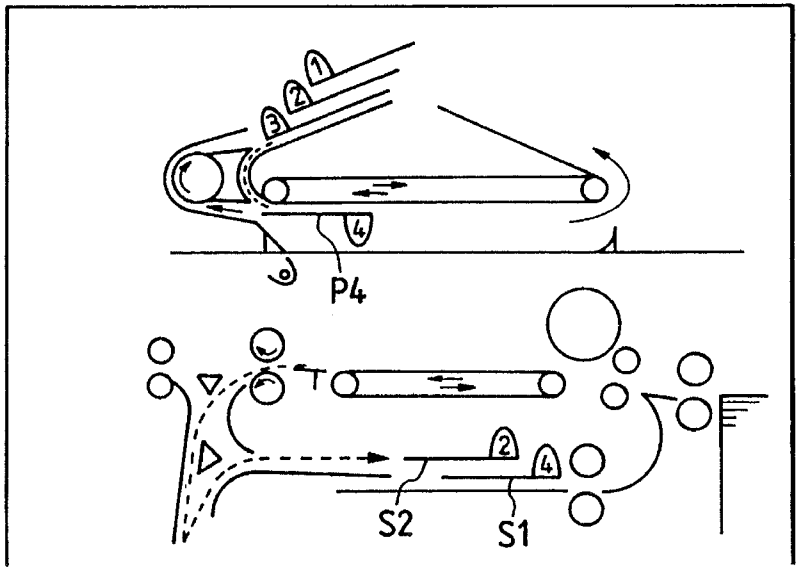
Figure 4E:
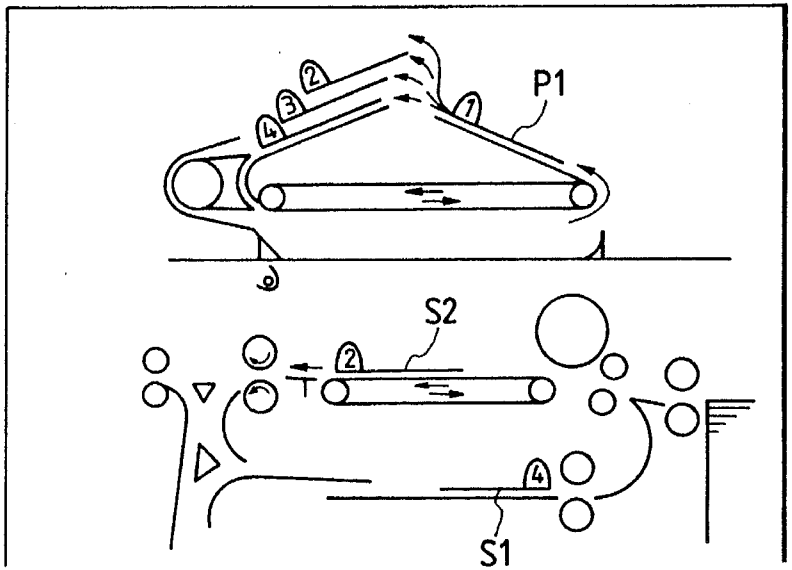
Figure 4H:
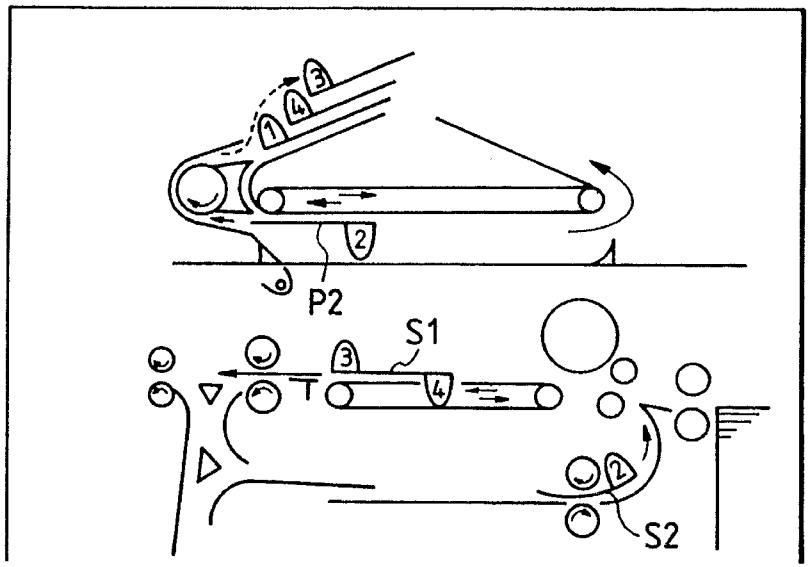
Figure 4G:
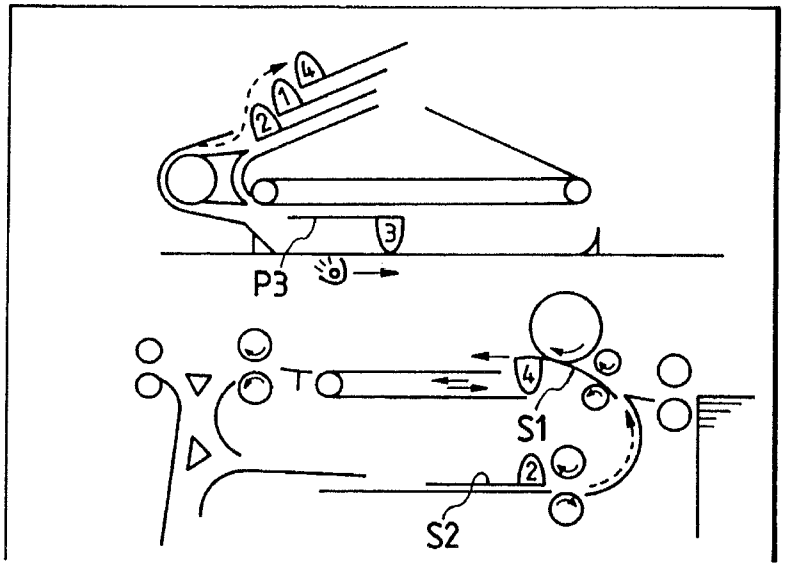
Figure 4J:
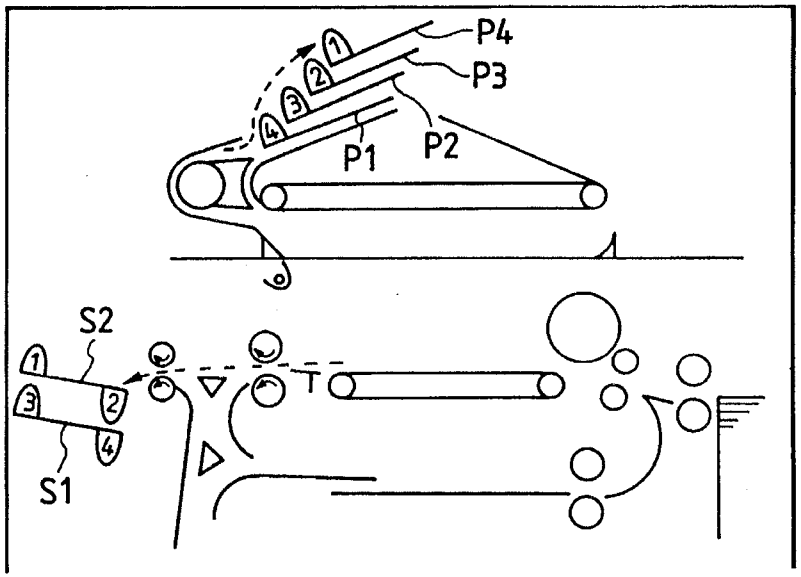
Figure 4I:
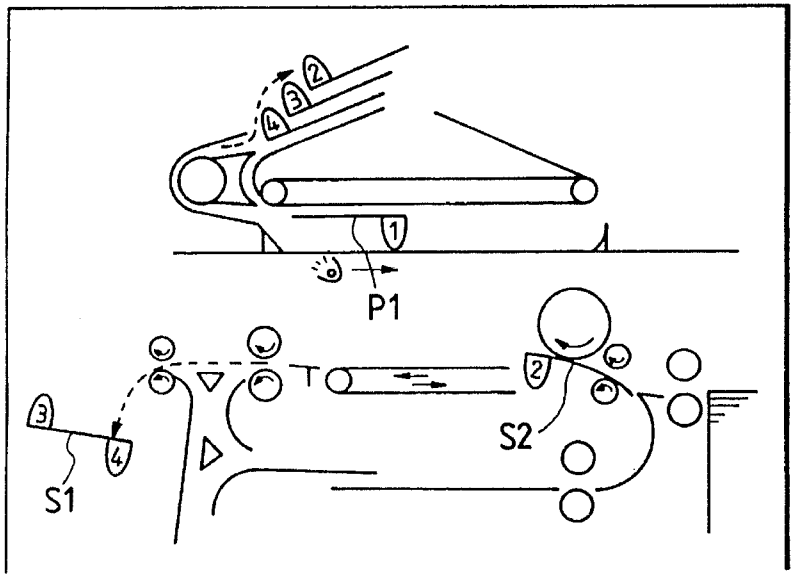

FIG. 2 shows the general construction of an image forming apparatus (copying machine) according to Embodiment 2 of the present invention.

In FIG. 2, the same members as those in the image forming apparatus of Embodiment 1 are given the same reference characters and need not be described.

In this image forming apparatus, a circulation path 68 for returning sheet materials fed out of the intermediate tray 55 to the intermediate tray 55 is provided between the re-feeding path 63 and the pair of register rollers 44. Thus, the sheet materials fed out of the intermediate tray 55 pass through the re-feeding path 63, and thereafter make a round through the circulation path 68. Where the sheet materials returned from the circulation path 68 to the intermediate tray 55 are of a small size, the trailing end regulating plate 56 is moved from the X1 position to the X2 position and regulates the trailing ends of the small-size sheet materials.

When the sheet materials fed out of the intermediate tray 55 are caused to make a round through the circulation path 68, the flapper 69 is changed over to a position 69*a*.

In the present image forming apparatus, the operation of the control portion, when, during the copying of a plurality of one-surface originals onto both surfaces of a plurality of sheet materials, jam occurs to the sheet materials re-fed from the intermediate tray 55, is performed in the same manner as in the case of the above-described Embodiment 1.

As described above, the image forming apparatus of the present invention has the function of grasping the number of unjammed sheet materials set in the intermediate tray when jam occurs to the sheet materials fed out of the intermediate tray and therefore, it becomes possible to set the unjammed sheet materials in the intermediate tray for reuse.

Also, the apparatus of the present invention has the circulation path for returning the sheet materials fed out of the intermediate tray to the intermediate tray and therefore, even in the case of a system in which the sheet materials in the intermediate tray are fed out one by one from the lowermost sheet material, it becomes possible that sheet materials for jammed sheet materials are stacked under unjammed sheet materials, and image formation in the order of pages can be effected on all sheet materials.

What is claimed is:

1. An image forming apparatus having an image forming portion, said image forming apparatus comprising:

an intermediate tray for containing sheets on which image formation has been effected, for another image formation, the sheets then being re-fed to the image forming portion to thereby effect plural times of image formation on the sheets; and counting means for counting the sheets contained in said intermediate tray, said counting means comprising a circulation path for returning the sheets fed out from said intermediate tray to said intermediate tray without passing the sheets through the image forming portion, and a counter for counting the sheets passing through said circulation path.

2. An image forming apparatus according to claim 1, further comprising second counting means for counting the number of sheets on which another image formation has been effected.

3. An image forming apparatus according to claim 2, further comprising control means for specifying, when an accident occurs to the re-fed sheets and the re-fed sheets are removed, the removed sheets from the count values of said first and second counting means.

4. An image forming apparatus according to claim 3, wherein said control means controls such that the same images as the images formed on the removed sheets previously contained in said intermediate tray may be formed on new sheets, and in place of the removed sheets, the new sheets may be contained in said intermediate tray.

5. An image forming apparatus according to claim 4, wherein said control means adjusts its position so that in place of the removed sheets, the new sheets contained in said intermediate tray may be re-fed in the same order as the order during the re-feeding of the removed sheets.

6. An image forming apparatus according to claim 5, further comprising image reading means for reading the image of an original and wherein the image forming portion forms on the sheets the image read by said image reading means.

7. An image forming apparatus according to claim 6, wherein the original is read at an image reading position of the image forming means, and said apparatus has an original feeding device for feeding the original to the image reading position.

8. An image forming apparatus according to claim 1, wherein the sheets contained in said intermediate tray are re-fed to the image forming portion, whereby image formation is effected on both surfaces of a sheet.

9. An image forming apparatus according to claim 1, wherein when an abnormality occurs, said counting means starts the counting, a user removes any unusable sheet from said image forming apparatus, and returns any usable sheet to said intermediate tray.

10. An image forming apparatus according to claim 9, further comprising a switch for causing said counting means to start the counting.

11. An image forming apparatus comprising:

image forming means for forming images on sheets;

containing means for containing therein the sheets on which the images have been formed by said image forming means;

feeding means for feeding the sheets contained in said containing means to said image forming means;

conveyance abnormality detecting means for detecting a conveyance abnormality of the sheets in the apparatus;

counting means for counting the sheets in said containing means; and control means for controlling such that when the conveyance abnormality is detected by said conveyance abnormality detecting means, said feeding means is stopped, the sheets in said containing means are counted by said counting means, images are formed on sheets on which no image is formed by said image forming means in conformity with the count value of said counting means, and the sheets are contained in said containing means.

12. An image forming apparatus according to claim 11, wherein said counting means comprises a circulation path for returning the sheets fed out of said containing means to said containing means, and a counter for counting the sheets passing through said circulation path.

13. An image forming apparatus according to claim 12, further comprising second counting means for counting the number of sheets on which a second image formation has been effected.

14. An image forming apparatus according to claim 13, further comprising control means for specifying, when an accident occurs to the re-fed sheets and the re-fed sheets are removed, the removed sheets from the count values of said counting means and said second counting means.

15. An image forming apparatus according to claim 14, wherein said control means controls such that the same images as the images formed on the removed sheets previously contained in said containing means may be formed on new sheets and in place of the removed sheets, the new sheets may be contained in said containing means.

16. An image forming apparatus according to claim 15, wherein said control means adjusts its position so that in place of the removed sheets, the new sheets contained in said containing means may be re-fed in the same order as the order during the re-feeding of the removed sheets.

17. An image forming apparatus according to claim 11, wherein said control means controls such that said feeding means stops the feeding when the conveyance abnormality is detected by said conveyance abnormality detecting means, and said counting means starts the counting and subsequent operations after any unusable sheet is removed from said image forming apparatus and any usable sheet is returned to said containing means.

18. An image forming apparatus according to claim 17, further comprising a switch for turning on said control means to start the counting and subsequent operations by said counting means.

19. An image forming apparatus comprising:

image reading means for reading the images of originals;

supplying means for supplying the originals to said image reading means;

image forming means for forming the images read by said image reading means on sheets;

containing means for containing therein the sheets on which the images have been formed by said image forming means;

feeding means for feeding the sheets contained in said containing means to said image forming means;

conveyance abnormality detecting means for detecting a conveyance abnormality of the sheets in the apparatus;

counting means for counting the sheets in said containing means; and control means for controlling such that when the conveyance abnormality is detected by said conveyance abnormality detecting means, said feeding means may be stopped, the sheets in said containing means may be counted by said counting means, deficient sheets and originals having thereon images to be formed on said deficient sheets may be discriminated by the count value of said counting means, the originals having thereon the images to be formed on said deficient sheets may be supplied to said image reading means by said supplying means, the images of said originals may be read by said image reading means and be formed on the sheets by said image forming means, and said sheets may be contained in said containing means.

20. An image forming apparatus according to claim 19, further having second counting means for counting the number of sheets on which second image information has been effected.

21. An image forming apparatus according to claim 20, further having control means for specifying, when an accident occurs to the re-fed sheets and the re-fed sheets are removed, said removed sheets from the count values of said counting means and said second counting means.

22. An image forming apparatus according to claim 21, wherein said control means controls such that the same images as the images formed on the removed sheets previously contained in said containing means may be formed on new sheets, and in place of the removed sheets, said new sheets may be contained in said containing means.

23. An image forming apparatus according to claim 22, wherein said control means adjusts its position so that in place of the removed sheets, the new sheets contained in said containing means may be re-fed in the same order as the order during the re-feeding of the removed sheets.

24. An image forming apparatus according to claim 19, wherein when the conveyance abnormality is detected by said conveyance abnormality detecting means, said control means stops said feeding means, and controls said counting means to effect the counting and subsequent operations after a user removes any unusable sheet from said image forming apparatus and returns any usable sheet to said containing means.

25. An image forming apparatus according to claim 24, further comprising a switch for turning on said control means to start the counting and succeeding operations by said counting means.

26. In an image forming apparatus wherein N sheets on which a first image formation has been effected are once contained in an intermediate tray for a second image formation and the sheets contained in said intermediate tray are re-fed to an image forming portion to thereby effect the second image formation on the same sheets, a recovery method when an accident occurs to the re-fed sheets and the re-fed sheets are removed, comprising the steps of:

a first step of counting a number $n_1$ of the sheets re-fed from said intermediate tray and on which the second image formation has been completed, and a number $n_2$ of the sheets remaining in said intermediate tray;

a second step of effecting the image formation effected on the $(n_1+1)$th to $(n_2-1)$th sheets during the first image information on $(N-n_1-n_2)$ new sheets;

a third step of containing in said intermediate tray the sheets on which the first image formation has been effected at the second step;

a fourth step of adjusting the order of the sheets in said intermediate tray so that the sheets contained in said intermediate tray may be re-fed in the order from the $(n_1+1)$th to Nth sheets; and a fifth step of re-feeding the sheets contained in said intermediate tray to the image forming portion.

27. A recovery method according to claim 26, wherein said image forming means forms the images of originals read by image reading means on the sheets.

28. A recovery method according to claim 27, wherein during the first image formation, said image forming means reads the images of even-number pages of originals of 2N pages of originals in the order from the pages greater in page number by said image reading means, forms the images of the read originals on the first surfaces of the N sheets, reads the images of odd-number pages of originals of the 2N pages of originals in the order from the pages greater in page number, and forms the images of the read originals on the second surfaces of the sheets re-fed at the fifth step.

29. A recovery method according to claim 26, wherein the sheets contained in said intermediate tray are re-fed in succession from the lowermost sheet, and at the third step, the sheets to be contained in said intermediate tray are contained in said intermediate tray in succession from above, and at the fourth step, the sheets contained in said intermediate tray are fed by $n_2$ sheets from the lowermost sheet, and are again contained in said intermediate tray in the order in which they have been fed.

30. A recovery method according to claim 29, wherein during the first image formation, said image forming means reads the images of even-number pages of originals of 2N pages of originals in the order from the pages greater in page number by image reading means, forms the images of the read originals on the first surfaces of N sheets, reads the images of odd-number pages of originals of the 2N pages of originals in the order from the pages greater in page number by said image reading means, and forms the images of the read originals on the second surfaces of the sheets re-fed at the fifth step.

31. A recovery method according to claim 26, wherein said first step starts after a user removes any unusable sheet from said image forming apparatus and returns any usable sheet to said intermediate tray.

32. A recovery method according to claim 26, wherein said second step and said third step are effected for every sheet on which the image is formed.

33. A recovery method according to claim 26, wherein said second step and said third step are repeated every time the image is formed on the sheet.

* * * * *

UNITED STATES PATENT AND TRADEMARK OFFICE

CERTIFICATE OF CORRECTION

PATENT NO. : 5,499,091

DATED : March 12, 1996

INVENTOR(S) : AKIHIRO KASIWABARA, et al.

It is certified that error appears in the above-indentified patent and that said Letters Patent is hereby corrected as shown below:

COLUMN 1

Line 15, "both-surface" should read --two-surface--.

COLUMN 2

Line 16, "beth" should read --both--.

COLUMN 4

Line 60, "suppled" should read --supplied--.

COLUMN 5

Line 30, "beth-surface" should read --both-surface--.

COLUMN 6

Line 20, "surfaces" should read --surface--.

UNITED STATES PATENT AND TRADEMARK OFFICE

CERTIFICATE OF CORRECTION

PATENT NO. : 5,499,091 Page 2 of 2

DATED : March 12, 1996

INVENTOR(S) : AKIHIRO KASIWABARA, et al.

It is certified that error appears in the above-indentified patent and that said Letters Patent is hereby corrected as shown below:

COLUMN 8

Line 61, "i.e. ," should read --i.e.,--.

Signed and Sealed this

Sixteenth Day of July, 1996

Bruce Lehman

*Attest:*

BRUCE LEHMAN

*Attesting Officer*

*Commissioner of Patents and Trademarks*